US006433659B1

(12) United States Patent
Malingowski et al.

(10) Patent No.: US 6,433,659 B1
(45) Date of Patent: Aug. 13, 2002

(54) CAM AND AXLE FOR ADJUSTABLE MAGNETIC TRIP DEVICE

(75) Inventors: Richard Paul Malingowski, Finleyville; Teresa Inez Hood; Trent Allen Chontas, both of Pittsburgh; Craig Allen Rodgers, Butler; Mark Zindler; William D. Munsch, both of Pittsburgh, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/526,233

(22) Filed: Mar. 15, 2000

(51) Int. Cl.[7] ..... H01H 9/00

(52) U.S. Cl. ..... 335/172; 335/167

(58) Field of Search ..... 335/23–25, 42, 335/167–176

(56) References Cited

U.S. PATENT DOCUMENTS 4,185,259 A * 1/1980 Fovargue ..... 335/167
5,831,501 A 11/1998 Kolberg et al.

* cited by examiner

*Primary Examiner*—Lincoln Donovan

(57) ABSTRACT

An adjustable magnetic trip device for a molded case circuit breaker is provided where the trip device includes a plunger and a stationary core as well as a plunger support structure with a movable plunger carriage. The position of the plunger assembly and carriage relative to the stationary core is determined by a cam assembly having a body with a plurality of sections, each section having a different radius. The plunger carriage is responsive to rotation of said cam assembly and may be adjusted by rotating the cam. The over-current condition for the trip device is a function of the distance between the plunger assembly and the stationary core. Accordingly, the over-current condition may be changed by rotating the cam. As each section of the cam has a constant radius, the over-current condition remains the same no matter where the carriage contacts a certain section of the cam.

7 Claims, 5 Drawing Sheets

CAM AND AXLE FOR ADJUSTABLE MAGNETIC TRIP DEVICE

BACKGROUND OF THE INVENTION

1. Field of the Invention

This invention relates to a circuit breaker with an adjustable magnetic trip device having a movable core and a stationary core and, more specifically, to a cam and axle which maintains each moveable core of a multi-core trip device at a consistent gap from an associated stationary core.

2. Description of the Prior Art

Molded case circuit breakers are well known in the art as exemplified by 5,927,484 issued Jul. 27, 1999 to Malingowski et al., U.S. Pat. No. 5,831,501 issued Nov. 3, 1998 to Kolberg et al., and by U.S. Pat. No. 4,503,408 issued Mar. 5,1985 to Mrenna et. al., entitled "Molded Case of Circuit Apparatus Having Trip Bar With Flexible Armature Interconnection" assigned to the assignee of the present application. The foregoing are incorporated herein by reference.

In molded case circuit breakers in which the power contacts, operating mechanism, and trip unit are mounted inside of a molded plastic insulative housing, a common type of magnetic trip device is a solenoid which includes a stationary core through which the current in the protected circuit is passed. The current passing through the stationary core creates a magnetic field. When there a very high instantaneous currents, such as those associated with a short circuit, the magnetic field intensifies. A plunger assembly, having a moveable core and a plunger tab which engages the trip latch on the operating mechanism, is partially disposed within the stationary core. Typically, a spring provides a limited force biasing the movable core away from the stationary core and preventing the plunger from engaging the trip latch. The force of the spring is overcome by the magnetic field generated by the stationary core during a short circuit. That is, when a short circuit occurs, the current in the stationary core creates a magnetic field strong enough to overcome the moveable core spring thereby allowing the moveable core to move toward the stationary core and causing the plunger to engage the trip latch.

The amount of current required to trip the device can be controlled by adjusting the amount of separation between the plunger assembly and stationary core. When the plunger assembly is located closer to the stationary core, a weaker magnetic field, and therefore a lower current, is required to draw the plunger assembly toward the stationary core to trip the device. In order to adjust the trip condition, the plunger assembly is mounted in a plunger assembly support structure having a base and a moveable plunger carriage. The carriage allows the plunger assembly, including the moveable core, to be moved relative to the stationary core. A carriage is used so that adjusting the gap between the moveable core and the stationary core does not impact on the compression of the moveable core biasing spring. The moveable plunger carriage is coupled to an adjustment device to address the initial gap between the plunger assembly and the stationary core.

As disclosed in Malingowski and Kolberg, prior art adjustment devices included adjustment means such as a cam or a rotatable disk having an angled surface. As these adjustment means are rotated, the trip condition is constantly changed, not unlike an analog device. That is, for every point for which the adjustment means is rotated, the moveable carriage and plunger assembly are moved toward or away from the stationary core, changing the amount of separation between the stationary and moveable cores. This is a disadvantage as users typically want the trip condition set to coincide with a discrete over-current condition. Because the adjustment means of the prior art change the trip condition for each point of rotation, it is difficult to set the trip device to trip at a precise over-current condition. For example, if the adjustment means is coupled to a wheel having a visual indication of various trip conditions and a pointer on the housing of the molded case circuit breaker where the user adjusts the wheel to adjust the trip condition, a user would have to set the wheel to be precisely aligned with, not slightly above or below, the visual indication in order for the trip device to be set at the indicated trip condition.

In a circuit breaker, such as a three phase breaker, having multiple main contacts, and therefore multiple adjustment means, an adjustment device having a smooth transition between various trip conditions is unlikely to place each movable core at the same degree of separation from the associated stationary core. Thus, if each adjustment means of a multiple main contact device is set slightly differently, the breaker will not be set to trip at a precise over-current condition. Additionally, such multiple unit trip devices are typically connected by an extended camshaft. Such a camshaft is subject to flexing which allows each cam to be set at a slightly different angle, and therefore, at a slightly different trip condition. Additionally, variations in the components during manufacture may result in a misalignment between the various trip units.

There is a need, therefore, for a molded case circuit breaker magnetic trip mechanism which sets the trip condition at a precise trip condition regardless of slight variation of the adjustment means.

There is a further need for a molded case circuit breaker magnetic trip mechanism which consistently sets the over-current condition for multiple main contacts within the circuit breaker.

There is a further need for a molded case circuit breaker magnetic trip mechanism which accommodates variations within the manufacturing tolerances of the trip mechanism components.

SUMMARY OF THE INVENTION

These needs and others are satisfied by the invention which provides magnetic trip adjustment scheme having a plunger assembly carriage coupled to a cam with a plurality of sections, each section having a constant radius. Thus, the plunger assembly carriage is maintained at a specific location so long as it is contacting the cam anywhere on a certain section. Where the circuit breaker has multiple main contacts, alignment of the magnetic trip units are maintained by a camshaft having an elongated coupling and crush ribs.

A molded case circuit breaker includes at least one pair of separable main contacts. The main contacts are disposed in the circuit breaker housing. The circuit breaker may be tripped manually by a handle or by a magnetic trip device. The magnetic trip device includes a rotating trip bar, a plunger assembly which includes a moveable core, and a stationary core. The stationary core is in electrical communication with the load side of the breaker. As electricity flows through the stationary core, a magnetic field is created. When an over-current condition occurs, the magnetic field intensifies, attracting the movable core of the plunger assembly. The plunger assembly includes a tab which contacts the rotating trip bar. When an over-current condition occurs and draws the moveable core towards the stationary core, the plunger tab causes the trip bar to rotate which in turn trips the breaker.

The plunger assembly is mounted in a moveable carriage which is responsive to a cam. By moving the carriage, the plunger assembly can be positioned closer to or further from the stationary core. When the plunger is closer to the stationary core, the magnetic force has a greater attracting effect. Thus, the over-current condition can be changed by moving the position of the plunger assembly relative to the stationary core. The cam, which positions the plunger carriage, is shaped to have a plurality of sections each with a specific constant radius. Each section positions the plunger assembly a specific distance from the stationary core. Each distance is associated with a specific and discrete over-current condition. The cam is coupled to a control mechanism, such as a wheel having a visual indication of the trip condition. Because the cam sections have a constant radius, a user does not have to set the control mechanism precisely. So long as the contact point between the moveable carriage and the cam is on the appropriate section of the cam, the carriage will be set to the indicated trip condition.

Additionally, when a circuit breaker has multiple main contacts, and therefore, multiple trip mechanisms, alignment between the trip mechanisms is more easily achieved by virtue of the cams with constant radius sections. This is because, even if the cams were at slightly different angles, the constant radius sections will maintain each carriage at the same distance from the stationary core. Thus, each unit will be set to trip at the same over-current condition. Additionally, when a trip mechanism has multiple units connected by an extended camshaft, this invention provides a camshaft which resists flexing so that each cam is angularly aligned.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENTS

Figure 1:
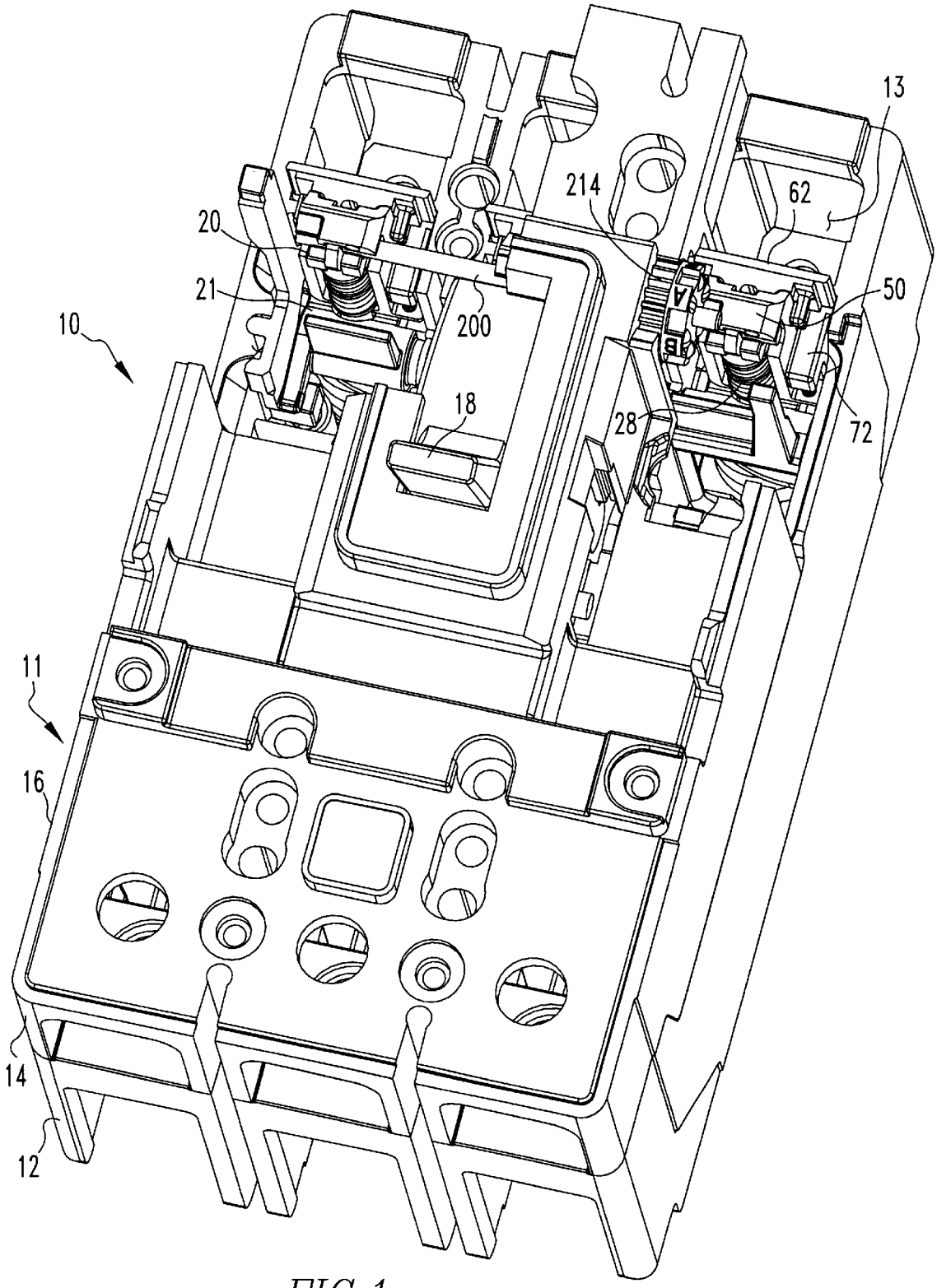
FIG. 1 is a partial cut away view of a circuit breaker housing incorporating the plunger carriage according to the present invention.
Figure 2:
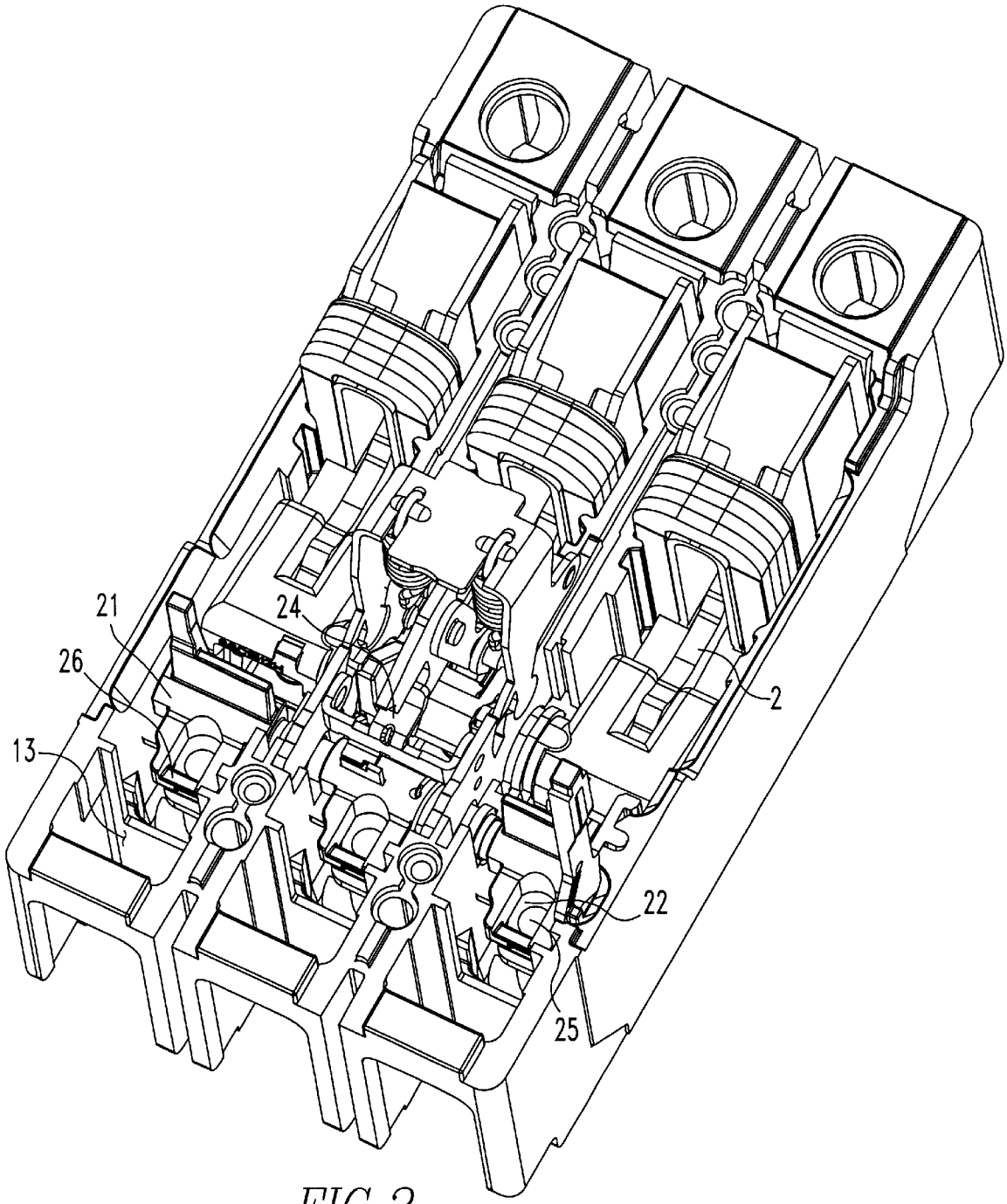
FIG. 2 is an isometric view of a circuit breaker with the top covers and plunger carriages removed.
Figure 3:
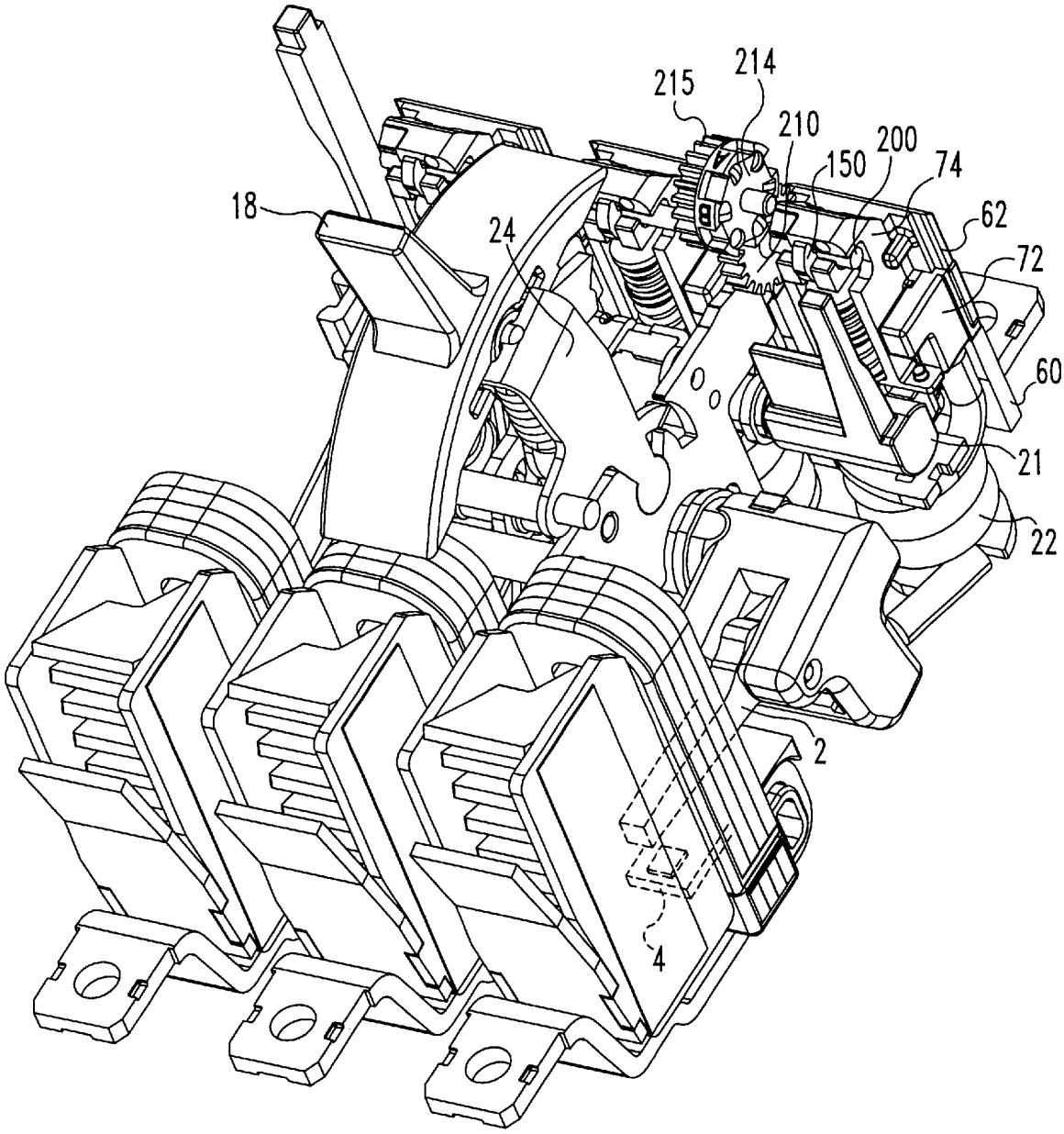
FIG. 3 is an isometric view of the circuit breaker mechanism without the circuit breaker housing.

Referring to the drawings, FIG. 1 shows a molded case circuit breaker 10 according to a preferred embodiment of the present invention. The molded case circuit breaker has a housing 11, which includes a base portion 12 which is coupled to a primary cover 14. Base portion 12 includes a plurality of cavities 13 which support the circuit breaker components (described below). Disposed on top of primary cover 14 is a secondary cover 16. An operating handle 18 protrudes through secondary cover 16. As shown in FIGS. 2 and 3, at least one pair of main contacts 2 are disposed within housing 11. The contacts include a moveable contact 2, and a stationary contact 4. The movable contact 2 is coupled to and is in electrical communication with the load side of the circuit breaker 10. The stationary contact 4 is coupled to and is in electrical communication with an electrical line (not shown). Handle 18 is coupled to a moveable contact 2 within the circuit breaker housing 11. Handle 18 may be used to reset the circuit breaker 10 after it has been tripped or may be used to manually open and close the circuit breaker 10.

As shown in FIG. 1, the circuit breaker 10 may be tripped by a separate magnetic trip assembly 20. The magnetic trip assembly 20 cooperates with a rotating trip bar 21, which is coupled to a latchable operating mechanism 24. As is known in the prior art, rotation of trip bar 21 will release the latchable operating mechanism 24 (FIGS. 2 and 3) allowing the circuit breaker 10 to trip. The trip bar 21 includes at least one actuating arm 26, which is adjacent to the magnetic trip assembly 20.

The magnetic trip assembly 20 includes a stationary core 22 (FIGS. 2 and 3), a plunger assembly 28 (FIG. 1) and a plunger assembly support structure 50. Stationary core 22 is disposed within a cavity 13 in the bottom housing 12. The stationary core 22 is preferably shaped as a coil. The stationary core 22 includes a medial aperture 25, preferably having a circular cross-section. The stationary core 22 is disposed between the moveable main contact 2 and a load-side collar (not shown). The load-side collar is in electrical communication with the electricity consuming load. When electricity flows through the stationary core 22 a magnetic field generating a magnetic force is created.

Figure 4:
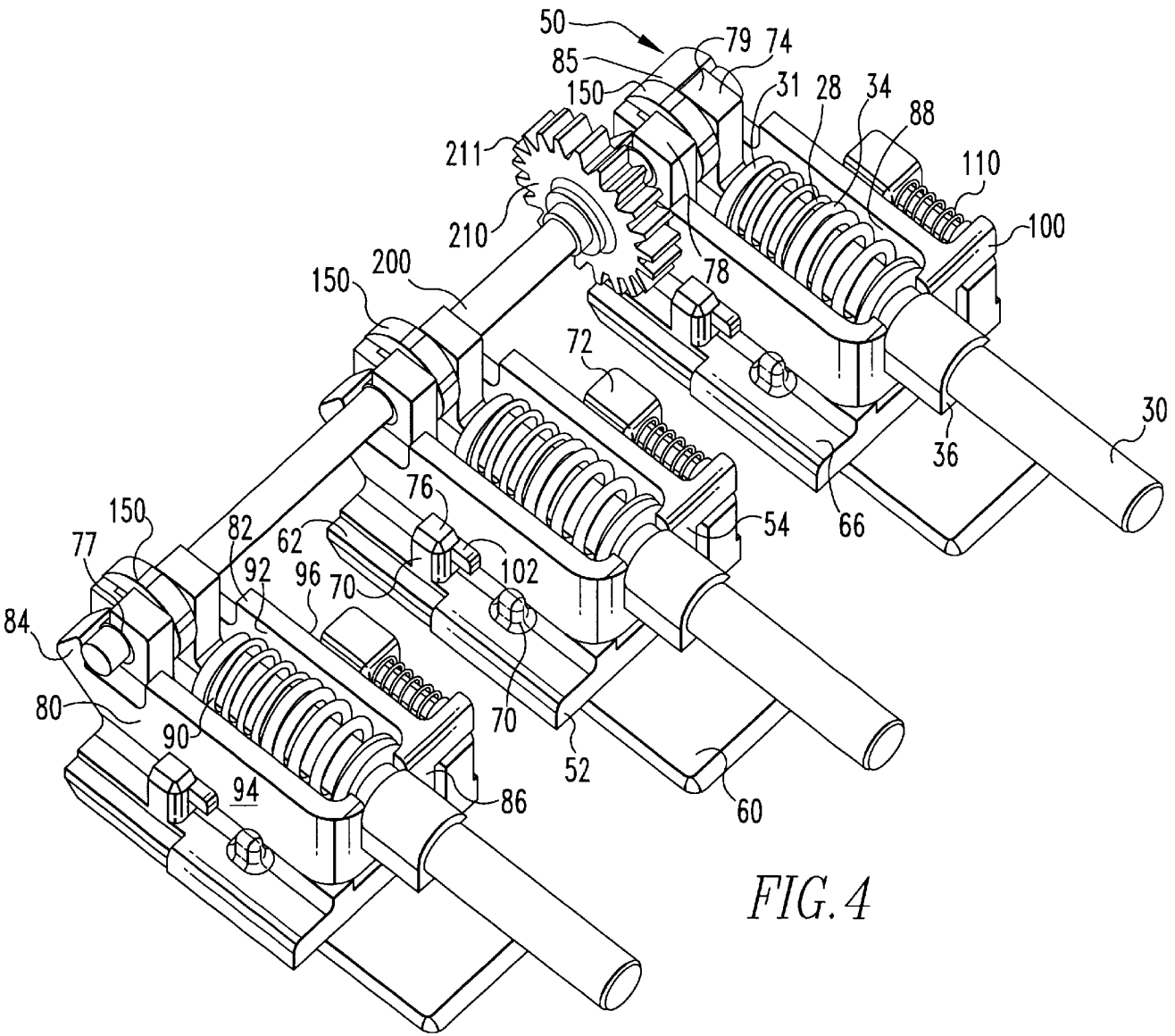
FIG. 4 is a perspective view of a plurality of plunger carriage support structure according to the present invention.

FIG. 4 shows a plurality of plunger assembly support structures 50 linked to each other by cam shaft 200. For ease of identification, certain components are identified in the figure on separate units, however, it is understood each unit includes each identified component. Plunger assembly 28 includes a moveable core 30, a coil spring 34 and a plunger tab 36. The moveable core includes a flattened end 31. As shown on FIGS. 2 and 3, the plunger assembly 28 is disposed within cavity 88 of plunger assembly support structure 50 (described below). One end of coil spring 34 contacts flattened end 31 while the other end contacts the support structure 50. Plunger tab 36 is positioned adjacent to actuating arm 26 of the trip bar 21 (FIG. 2).

The strength of the magnetic force, which changes in relation to the amount of current through stationary core 22, necessary acting on the plunger assembly 28 is a function the distance between the stationary core 22 and the moveable core 30. Accordingly, the over-current situation for breaker 10 may be adjusted by moving the moveable core 30 closer or further from the stationary core 22. When the moveable core 30 is closer to stationary core 22, the strength of the magnetic force, and therefore the amount of current through stationary core 22, required to overcome the bias of coil spring 34 is reduced as compared to the magnetic force, and therefore current through stationary core 22, required to overcome the bias of coil spring 34 when moveable core 30 is further from stationary core 22. The plunger carriage assembly 54, which supports the plunger assembly 28 and moveable core 30, is slidably disposed adjacent to base member assembly 52 to accomplish this adjustment.

In operation, plunger assembly support structure 50 may be coupled to the circuit breaker housing 11 in a base portion cavity 13. Tab 60 cooperates with cavity 13 to position plunger assembly support structure 50 so that the end of moveable core 30 opposite flattened end 31 is partially disposed in stationary core aperture 25. When so disposed, the magnetic force generated by electric current through stationary core 22 acts on moveable core 30 of plunger assembly 28, as explained above. Additionally, when plunger assembly support structure 50 is coupled to cavity 13, plunger tab 36 is positioned adjacent to trip bar actuating arm 26. Under normal operating conditions, coil spring 34 overcomes the magnetic force created by the electric current through stationary core 22 and biases flattened end 31 of moveable core away from plunger carriage bottom member 86 and stationary coil 22. The biasing force of coil spring 34 also prevents plunger tab 36 from engaging trip bar actuating arm 26.

When an over-current situation occurs, however, the magnetic force created by the current through stationary core 22 increases in strength. When the magnetic force becomes strong enough to overcome the bias of coil spring 34, the plunger assembly 28 is drawn towards stationary core 22. As the plunger assembly 28 is drawn towards stationary core 22, plunger tab 36 engages trip bar actuating arm 26 causing the trip bar 21 to rotate. When trip bar 21 rotates, latchable operating mechanism 24 is released allowing the circuit breaker 10 to trip.

Figure 5:
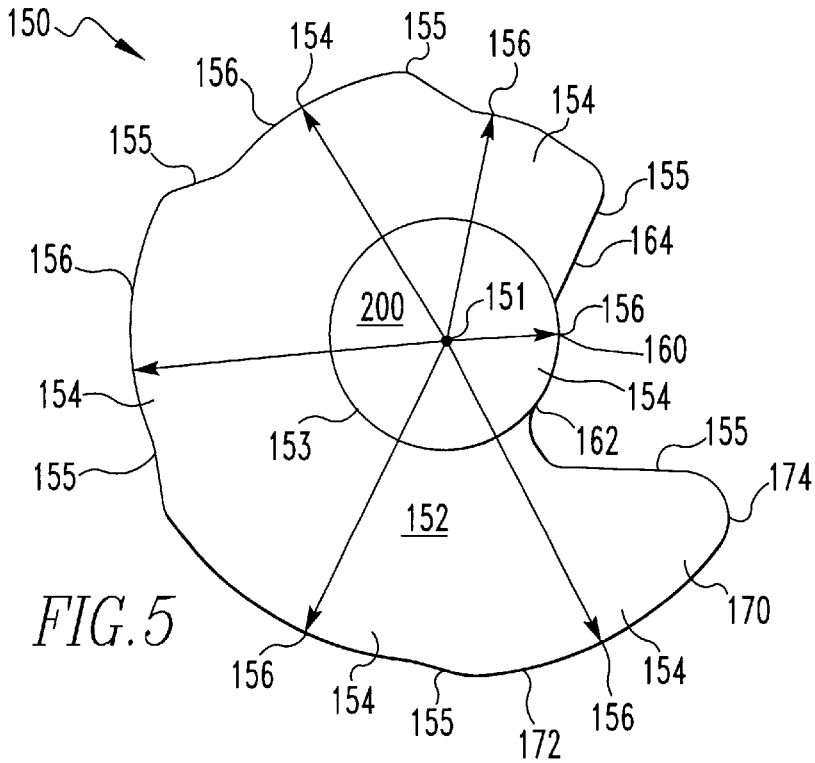
FIG. 5 is a cross sectional view of a cam assembly according to the present invention.

The distance of separation between the plunger assembly 28 and the stationary core 22 is controlled by cam assembly 150. As shown in FIG. 5, cam assembly 150 includes a central axis 151 and a generally circular body 152 having a medial opening 153 and plurality of sections 154. Each section 154 has an arcuate outer surface 156. Each arcuate outer surface 156 has a constant radius which is centered about axis 151. Each arcuate outer surface 156 has a different radius from the adjacent arcuate outer surfaces 156. Between each constant radius section is a transition area 155. In a preferred embodiment, cam assembly 150 includes a minimum radius section 160, having a first side 162 and a second side 164, and a maximum radius section 170, having a first side 172 and a second side 174. The minimum radius section first side 162 is adjacent to the maximum radius section second side 174. The remaining plurality of sections 154 are disposed about generally circular body 152 between the minimum radius section second side 164 and the maximum radius section first side 172. In a more preferred embodiment, each section 154 increases in radius between the minimum radius section second side 164 and the maximum radius section first side 172. Minimum radius section 160 may be integral to a camshaft 200 passing through medial opening 153.

As shown in FIG. 4, the plunger assembly support assembly 50 includes a base member assembly 52 and a plunger carriage assembly 54. The plunger assembly 28 is disposed within the plunger carriage assembly 54. The plunger carriage assembly 54 is slidably disposed adjacent to the base member assembly 52. The plunger carriage assembly 54 is slidable so that the distance between the moveable core 30 and the stationary core 22, and therefore the trip condition of the circuit breaker 10, may be selectively adjusted.

Base member assembly 52 includes a mounting tab 60, a body 62 having a front face 64 and a camshaft nest 74. Cam shaft nest 74 includes two spaced apart tabs 78, 79. Each tab 78, 79 includes a rounded cutout shaped to engage camshaft 200. The base member 52 further includes a plurality of guides 70 extending from the body front face 64. The guides 70 are spaced to fit on either side of the plunger carriage assembly 54 (described below). The guides 70 are positioned so that at least two guides 70 are on one side of plunger carriage assembly 54, and at least one guide 70 is on the opposite side of plunger carriage assembly 54. Body 62 further includes a spring housing 72 extending from the body front face 64. Any of the guides 70 or spring housing 72 may include guide grooves 76 shaped to cooperate with an alignment ridge 102 (described below). The body 62 also includes a camshaft nest 74.

The plunger carriage assembly 54 includes a first side member 80 and a second side member 82. The first side member 80 and the second side member 82 are held in spaced relation by a top member 84 and a bottom member 86. An open-faced cavity 88 is formed between the first side member 80 and the second side member 82. Both the first side member 80 and the second side member 82 each have an interior side 90, 92 and an exterior side 94, 96 respectively. The first side member exterior side 94 includes a spring tab 100 extending therefrom. The first side member exterior side 94 has an alignment ridge 102. The second side member exterior side 96 also has an alignment ridge (not shown). Top member 84 includes a cam follower 85.

As noted above, the plunger carriage assembly 54 is slidably disposed adjacent to base member assembly 52. The plunger carriage assembly 54 is slidable between a first and second position. The carriage assembly 54 is movable in response to an over-current condition or in response to rotation of the cam assembly 150. When assembled, as shown in FIG. 4, with plunger carriage 54 between guides 70 on base member 52, cam nest 74 and top member 84 are adjacent to each other with cam follower 85 aligned with the space between tabs 78, 79. A spring member 110 may be disposed between the spring housing 72 and spring tab 100. Cam assembly 150 is rotatably disposed between tabs 78, 79 with camshaft 200 resting in cutouts 77. Spring member 110 acts on carriage 54 so that cam follower 85 is biased against cam assembly 150 and, more specifically, outer surface 156. Thus, because each cam section 154 has a different constant radius, plunger carriage assembly 54 may move specific distances relative to base member 52 as cam assembly 150 is rotated.

As noted above, the plunger carriage assembly 54 is slidably disposed adjacent to base member assembly 52. The carriage assembly 54 is movable in response to an over-current condition and in response to rotation of the cam assembly 150. When assembled, as shown in FIG. 2, with plunger carriage assembly 54 between guides 70 on base member assembly 52, cam nest 74 and top member 84 are adjacent to each other with cam follower 85 aligned with the space between tabs 78, 79. Cam assembly 150 is rotatably disposed between tabs 78, 79 with camshaft 200 resting in cutouts 77. Spring 110 biases plunger carriage 54 so that cam follower 85 contacts cam assembly 150. Thus, when cam assembly 150 rotates, cam follower 85 contacts the outer surface 156 of the various cam sections 154. Because each cam section 154 has a different radius, the plunger carriage assembly 54 moves relative to the base member assembly 52 as cam assembly 150 is rotated. Thus, the trip condition may be selectively controlled by rotating cam assembly 150 to adjust the separation between the stationary core 22 and the plunger assembly 28.

As shown in FIG. 4 cam assembly 150 may be coupled to an adjusting gear 210. Adjusting gear 210 may be mounted on camshaft 200. Adjusting gear 210 includes a plurality of teeth 211. As shown in FIGS. 1 and 3, adjusting gear 210 is coupled to an adjusting means such as wheel 214. Wheel 214 includes teeth 215 which may be coupled with adjusting gear teeth 211. Wheel 214 is mounted in housing 11 with a portion of wheel 214 visible through secondary cover 16. Wheel 214 may also include indicia, such as numbering or lettering. When circuit breaker 10 is assembled, wheel teeth 215 mesh with adjusting gear teeth 211 so that rotating wheel 214 causes cam assembly 150 to rotate. In this configuration, the adjusting means can be structured so that an indicia on wheel 214 is associated with cam assembly 150 being in a certain position and plunger assembly 54 being a certain distance from stationary core 22. Thus, the indicia on wheel 214 can be associated with various trip conditions.

Figure 6:
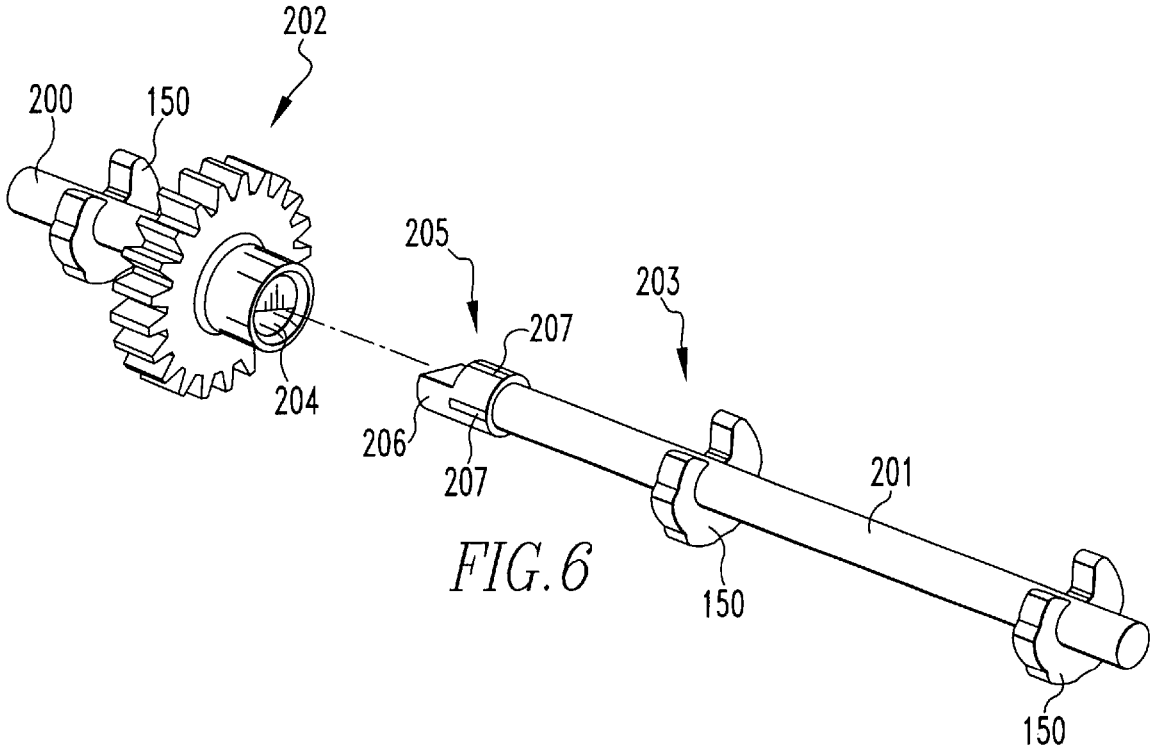
FIG. 6 is an isometric view of a two-part camshaft.

A plurality of plunger assembly support structures 50 may be assembled in series to cooperate with a circuit breaker which has more than one set of main contacts. As shown in FIG. 6, in such a multiple unit configuration, the plunger assembly support structures 50 are coupled by an extended camshaft 201. Such an extended camshaft 201 may be formed integrally, however, in the preferred embodiment, the extended camshaft 201 is formed of two pieces, a base unit 202 and an extension 203. The base unit 202 preferably includes one cam assembly 150, a camshaft 200, an adjusting gear 210, and an elongated recess 204. Elongated recess 204 is preferably a semi-circular recess, however, any shape may be used. Extension 203 includes a camshaft 200, a plurality of cams 150 and a mating end 205. Mating end 205 includes an extended tab 206 shaped to fit in elongated recess. A plurality of crush ribs 207 are disposed about extended tab 206. The crush ribs 207 are raised ridges extending axially along tab 206. The crush ribs ensure that tab 206 will be frictionally held in elongated recess 204.

While specific embodiments of the invention have been described in detail, it will be appreciated by those skilled in the art that various modifications and alternatives to those details could be developed in light of the overall teachings of the a disclosure. Accordingly, the particular arrangements disclosed are meant to be illustrative only and not limiting as to the scope of invention which is to be given the full breadth of the claims appended and any and all equivalents thereof.

What is claimed is:

1. An adjustable plunger assembly support structure for a magnetic trip device for a molded case circuit breaker, said trip device comprising:

a base member assembly;

a movable plunger carriage disposed adjacent to said base member assembly;

a cam assembly;

said cam assembly having a cam member body with a plurality of sections, each said section having a different constant radius for selective engagement and positioning of said plunger carriage by said sections;

wherein said body is generally circular in shape;

said body includes a minimum radius section having a first side and a second side and a maximum radius section adjacent to said minimum radius section first side;

said plurality of sections are disposed about said body between said minimum radius section second side and said maximum radius section;

wherein said sections between said minimum radius section second side and said maximum radius section increase in radius;

wherein said plunger carriage includes a cam follower contacting said cam sections; and wherein said base member assembly includes a cam cradle.

2. An adjustable magnetic trip device for a molded case circuit breaker, said trip device, comprising:

a plurality of plunger support structures, each having a cam assembly and a base member assembly;

said cam assemblies each having a body having a plurality of sections, each said section having a constant radius;

a movable plunger carriage disposed adjacent to said base member assembly;

said plunger carriage responsive to rotation of said cam assembly;

said plurality of plunger support structures connected by an extended camshaft;

wherein said extended camshaft includes a base unit and an extension;

said base unit having an elongated recess;

said extension having an elongated tab shaped to fit said elongated recess;

wherein said elongated tab includes a plurality of crush ribs;

wherein said body is generally circular in shape;

said body includes a minimum radius section having a first side and a second side and a maximum radius section adjacent to said minimum radius section first side;

said plurality of sections are disposed about said body between said minimum radius section second side and said maximum radius section;

wherein said sections between said minimum radius section second side and said maximum radius section increase in radius;

wherein said plunger carriage includes a cam follower contacting said cam sections;

wherein said base member assembly includes a cam cradle; and said cam assembly disposed between said cam cradle and said cam follower.

3. A circuit breaker, comprising:

a housing;

at least one pair of separable main contacts;

a magnetic trip device coupled to said main contacts;

said magnetic trip device comprising:

a plunger support structure having a cam assembly and a base member assembly;

said cam assembly including a body having a plurality of sections, each said section having a constant radius;

a movable plunger carriage disposed adjacent to said base member assembly;

said plunger carriage responsive t rotation of said cam assembly;

wherein said body is generally circular in shape;

said body includes a minimum radius section having a first side and a second side and a maximum radius section adjacent to said minimum radius section first side;

said plurality of sections, are disposed about said body between said minimum radius section second side and said maximum radius section;

wherein the sections between said minimum radius section second side and said maximum radius section increase in radius; and wherein said plunger carriage includes a cam follower contacting said cam sections.

4. The plunger assembly support structure of claim 1, wherein said cam assembly includes a cam shaft and an adjusting gear.

said adjusting gear structured to be coupled to an adjustment means on a circuit breaker housing.

5. The trip device of claim 3, wherein said cam assembly includes a camshaft and an adjusting gear;

said gear structured to be coupled to an adjustment means on a circuit breaker housing

6. The circuit breaker of claim 3, wherein said base member assembly includes a cam cradle.

7. The circuit breaker of claim 6, wherein said cam assembly includes a camshaft and an adjusting gear said gear structured to be coupled to an adjustment means on said circuit breaker housing.

* * * * *